US007479076B2

(12) United States Patent
Verga

(10) Patent No.: US 7,479,076 B2
(45) Date of Patent: Jan. 20, 2009

(54) ONE TOUCH RELEASE TENNIS BALL RETRIEVER

(76) Inventor: Jose A. Verga, 4065 Walnut St., Baldwin Park, CA (US) 91706

( * ) Notice: Subject to any disclaimer, the term of this patent is extended or adjusted under 35 U.S.C. 154(b) by 202 days.

(21) Appl. No.: 11/406,086

(22) Filed: Apr. 18, 2006

(65) Prior Publication Data

US 2007/0111829 A1 May 17, 2007

Related U.S. Application Data

(60) Provisional application No. 60/737,698, filed on Nov. 17, 2005.

(51) Int. Cl.
*A63B 47/02* (2006.01)

(52) U.S. Cl. ..... 473/517; 294/19.2

(58) Field of Classification Search ..... 473/517, 473/286; 294/19.2
See application file for complete search history.

(56) References Cited

U.S. PATENT DOCUMENTS 2,551,486 A * 5/1951 Burden ..... 294/19.2
2,962,321 A * 11/1960 Fowler et al. ..... 294/19.2
4,058,336 A * 11/1977 Parkinson ..... 294/19.2
4,063,769 A * 12/1977 Zimmer ..... 294/19.2
5,147,101 A * 9/1992 Tiller ..... 294/19.2
5,437,488 A * 8/1995 Richmond et al. ..... 294/19.2
5,505,510 A * 4/1996 Duncan ..... 294/19.2
5,975,600 A * 11/1999 Hwang ..... 294/19.2
D442,658 S * 5/2001 Loerop et al. ..... D21/721
D445,469 S * 7/2001 Loerop et al. ..... D21/721
6,419,600 B1 * 7/2002 York et al. ..... 473/517
6,739,477 B1 * 5/2004 Pascual ..... 221/199
7,309,293 B2 * 12/2007 Dunks ..... 473/286
2002/0117870 A1 * 8/2002 Cash ..... 294/19.2
2007/0111829 A1 * 5/2007 Verga ..... 473/517

* cited by examiner

*Primary Examiner*—Raleigh W. Chiu
(74) *Attorney, Agent, or Firm*—Michael I Kroll

(57) ABSTRACT

A tennis ball retriever has a ball tube, handle assembly, and a one-touch release mechanism, which is simplified and easy to use.

5 Claims, 3 Drawing Sheets

ONE TOUCH RELEASE TENNIS BALL RETRIEVER

CROSS REFERENCE TO RELATED APPLICATIONS

Reference is made to my Provisional Application No. 60/737,698, filed Nov. 17, 2005, entitled One Touch Release Tennis Ball Retriever.

STATEMENT REGARDING FEDERALLY SPONSORED RESEARCH OR DEVELOPMENT

Not applicable.

REFERENCE TO MICROFICHE APPENDIX

Not applicable.

BACKGROUND AND SUMMARY OF THE INVENTION

The present invention relates generally to tennis ball retrievers, more particularly to a tennis ball retriever having a one-touch release.

Tennis is a very popular sport. An effective and economic way of practicing the game is to repeatedly hit the balls fed by a machine. A large number of tennis balls will be used in practice, therefore a tennis ball retrieving device is often used to retrieve the balls. The existing tennis ball retrievers are mostly heavy, inconvenient to use, and expensive, or may not be very effective.

The present invention provides a useful and novel one-touch release tennis ball retriever that is light, easy to use, and inexpensive.

In one preferred embodiment of the invention, the one-touch release tennis ball retriever comprises a tennis ball tube, a handle assembly, and a one-touch release mechanism. The tennis ball tube is of tubular shape generally, having an opening slot at the lower end of the tennis ball tube, a tube outer surface, and a tube inner surface. The handle assembly comprises a first handle piece, a second handle piece, a first fixing piece, a second fixing piece, a tip fixing means, a middle fixing means, and an end fixing means. The one-touch release mechanism further comprises a stop and slip pin, a first lever piece, a second lever piece, a first pivot, a second pivot, and a lever mounting means.

The tennis ball retriever of the present invention can be used by positioning the lower end of the tennis ball tube close to the tennis ball, and then push the tube by holding the handle assembly and move downward. The tennis ball will slip into the tube by pushing the stop and slip pin of the one-touch release mechanism. The stop and slip pin will bounce back to ordinary position after the push and stop the falling of the tennis ball so that the stop and slip pin locks the tennis balls, and all the balls collected will remain inside the tennis ball tube. To release the balls inside the tube, the lever of the one-touch release mechanism must be pressed so the stop and slip pin will retract and give way to the gravities of the balls so that the balls will fall down. By removing the finger that is pressing the lever, the stop and slip pin will return to its normal position.

In another preferred embodiment, the stop and slip pin can also be controlled by a spring attached inside between the base and the upper level.

DETAILED DESCRIPTION OF THE INVENTION

Figure 1:
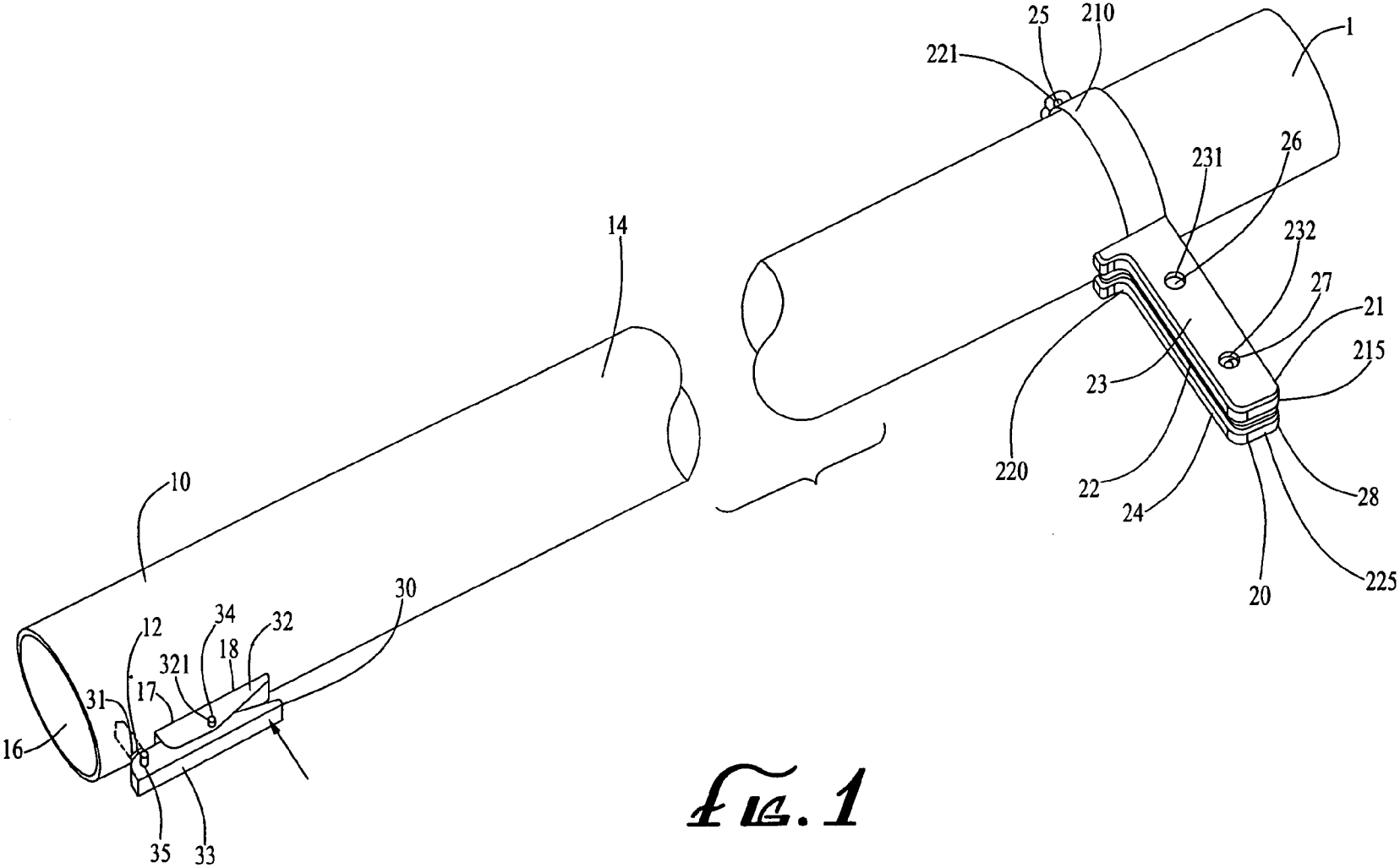
FIG. 1 is a perspective view of the one-touch release tennis ball retriever of the present invention.
Figure 2:
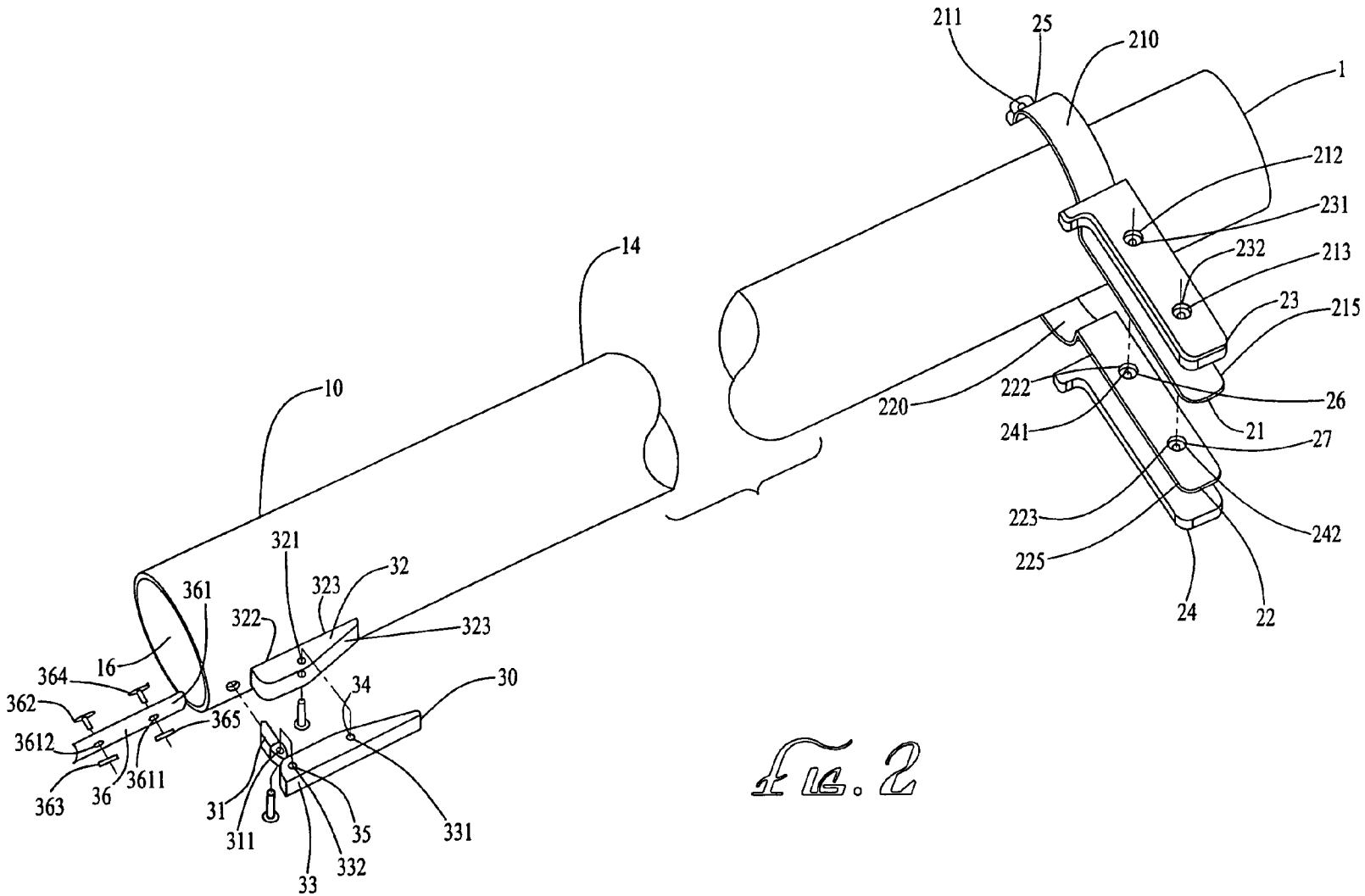
FIG. 2 is a cross-sectional view of the one-touch release tennis ball retriever of the present invention.
Figure 3:
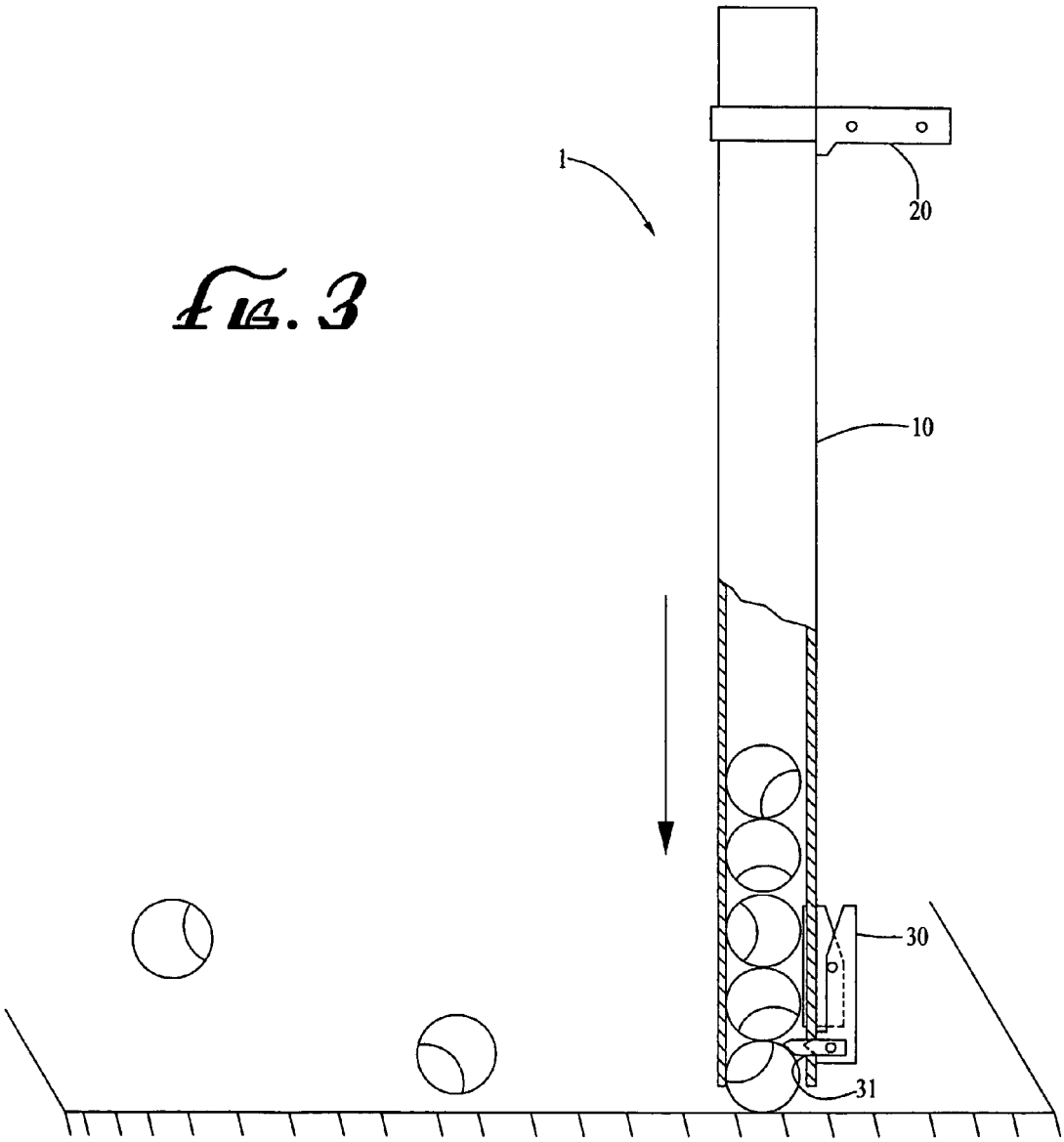
FIG. 3 is a diagrammatic elevational view of the one-touch release tennis ball retriever of FIGS. 1 and 2.

As shown in FIG. 1, the one-touch release tennis ball retriever 1 of one of the preferred embodiments of the present invention, comprises a tennis ball tube 10, a handle assembly 20, and a one-touch release mechanism 30. As in FIG. 1, the tennis ball tube 10 is in tubular shape generally, having an opening or slot 12 at the lower end of the tennis ball tube 10, a tube outer surface 14 and a tube inner surface 16, a first tube mounting hole 17 and a second tube mounting hole 18.

As in FIG. 1, the handle assembly 20 comprises a first handle piece 21, a second handle piece 22, a first fixing piece 23, a second fixing piece 24, a tip fixing means 25, a middle fixing means 26, and an end fixing means 27. The first handle piece 21 and the second handle piece 22 comprises a first circular strip 210 and a second circular strip 220, a first flat strip 215 and a second flat strip 225, respectively. The first handle piece 21 has a first tip mounting hole 211, a first middle mounting hole 212, and a first end mounting hole 213.

The second handle piece 22 has a second tip mounting hole 221, a second middle mounting hole 222, and a second end mounting hole 223. The first fixing piece 23 has a first front mounting hole 231 and a first back mounting hole 232. The second fixing piece 24 has a second front mounting hole 241, and a second back mounting hole 242.

In one preferred embodiment, the tip fixing means 25, the middle fixing means 26, and the end fixing means each comprises a bolt and a nut, respectively.

The bolts can extend through the first tip mounting hole 211 and the second tip mounting hole 221, the first front mounting hole 231, the first middle mounting hole 212, the second middle mounting hole 222, the second front mounting hole 241, the first back mounting hole 232, the first end mounting hole 213, the second end mounting hole 223, and the second back mounting hole 242.

When the nuts are tightened to the bolts, the first flat strip 215 of the first handle piece 21 will be tightly pressed to the second flat strip 225 of the second handle piece 22 to form a handle 28, and the first circular strip 210 of the first handle piece 21 and the second circular strip 220 of the second handle piece 22 will press tightly against the tube outer surface 14 and attach the handle assembly 20 to the tennis ball tube 10.

The quick one-touch release mechanism 30 comprises a stop and slip pin 31 arrangement, a first lever piece 32, a second lever piece 33, first pivot 34, a second pivot 35, and a lever mounting means 36.

The slip pin 31 has a pin mounting hole 311.

The first lever piece 32 has a first lever top mounting hole 321, a first lever mounting hole 322, and a first lever and side mounting hole 323.

In a preferred embodiment, the lever mounting means 36 comprises a lever mounting piece 361 having a lever mounting front hole 3611, and a lever mounting piece back hole 3612, a front lever hole 362, a front lever nut 363, a back lever bolt 364, and a back lever nut 365.

The front lever bolt 362 may extend through the first lever mounting hole 322, the first tube mounting hole 17, lever mounting piece front hole 3611, and be tightened by front lever nut 363.

First pivot 34 passes through the first lever top mounting hole 321 and a second lever mounting hole 331.

The stop and slip pin 31 is joined with the second lever piece 33 by a second pivot 35 when it passes through the pin mounting hole 311 and second lever pin mounting hole 332.

The one-touch release tennis ball retriever according to the invention can be utilized by positioning the lower end of the ball tube 10, and then push the tennis ball down by holding the handle 28 of the assembly 20 and move downwardly.

Release of the balls in the tube is effected when the second lever piece 33 of the one-touch release mechanism 30 is operated by pressing it, so the stop and slip pin 31 are retracted and so that the balls fall down. By removal of the finger which is pressing on the second lever 33, stop and slip pin 31 will return to its normal position.

In another preferred embodiment, the stop and slip pin 31 can also be controlled by a spring attached inside between the base and the upper level.

A ball or balls will slip into the tube 14 by pushing a slip pin 31 which is retracted so the balls fall from the tube.

Pushing the one-touch release mechanism 36 by a person's finger past second lever 33 and slip pin 31, returns the mechanism to normal position.

Retraction and pushing slip pin 31 causes the ball to fall from the tube.

It will be understood that various changes and modifications may be made from the preferred embodiments discussed above without departing from the scope of the present invention, which is established by the following claims and equivalents thereof.

The inventor claims:

1. Apparatus for handling tennis balls comprising:

an elongated housing having upper and lower ends, said housing being adapted to receive therein a plurality of tennis balls, and quick release means on a lower portion of the housing and operable to releasably retain and to quickly release said balls from a lower end portion of the elongated housing; and wherein said quick release means is a one-touch release mechanism comprises a stop and slip pin, first and second lever pieces, first and second pivots and a lever mounting means.

2. Apparatus according to claim 1, wherein said elongated housing is generally tubular.

3. Apparatus according to claim 1, further comprising handle means on an upper portion of the elongated housing for manual grasping and handling of the apparatus.

4. Apparatus according to claim 1, further comprising retainer means hand or foot operable to release balls from the lower portion of said elongated housing.

5. Apparatus according to claim 1, wherein the second lever piece is operable to release balls from said elongated housing by causing the stop and slip pin to retract to enable the balls to fall from the elongated housing.

* * * * *